United States Patent [19]

Williams

[11] 4,385,732

[45] May 31, 1983

[54] WASTE MATERIAL BREAKING AND SHREDDING APPARATUS

[76] Inventor: Robert M. Williams, 16 La Hacienda, Ladue, Mo. 63124

[21] Appl. No.: 182,666

[22] Filed: Aug. 29, 1980

[51] Int. Cl.[3] ..... B02C 13/00

[52] U.S. Cl. ..... 241/167, 236, 285 A, 285 B, 243 241/285 B

[58] Field of Search ..... 241/32, 36, 73, 166, 241/167, 362, 285 A, 285 B, 243

[56] References Cited

U.S. PATENT DOCUMENTS

| | | | |
|---|---|---|---|
| 3,578,252 | 5/1971 | Brewer | 241/141 |
| 3,664,592 | 4/1972 | Schweigert et al. | 241/73 |
| 3,868,062 | 2/1975 | Cunningham | 241/36 |
| 3,991,944 | 11/1976 | Baiuoff | 241/36 |
| 4,002,302 | 1/1977 | Miller | 241/285 B |
| 4,009,836 | 3/1977 | Strom et al. | 241/285 B X |
| 4,046,324 | 9/1977 | Chambers | 241/46.06 |

*Primary Examiner*—Mark Rosenbaum
*Assistant Examiner*—Timothy V. Eley
*Attorney, Agent, or Firm*—Gravely, Lieder & Woodruff

[57] ABSTRACT

Apparatus for reducing waste material in which substantially parallel shafts carry cooperating material reducing cutters for either direction of rotation of the shafts. There are selectively positionable cages at the discharge with comb teeth in position to cooperate with the cutters in either direction of cutter rotation, and there is a control system for operating the cutters and cages such that for normal reduction of waste material the cutters are rotated in a first direction and the cages are positioned to produce a desired size of reduced waste material, and the cutters are rotated in a second direction while the cages are positioned to release non-reducible material.

8 Claims, 5 Drawing Figures

FIG. 1
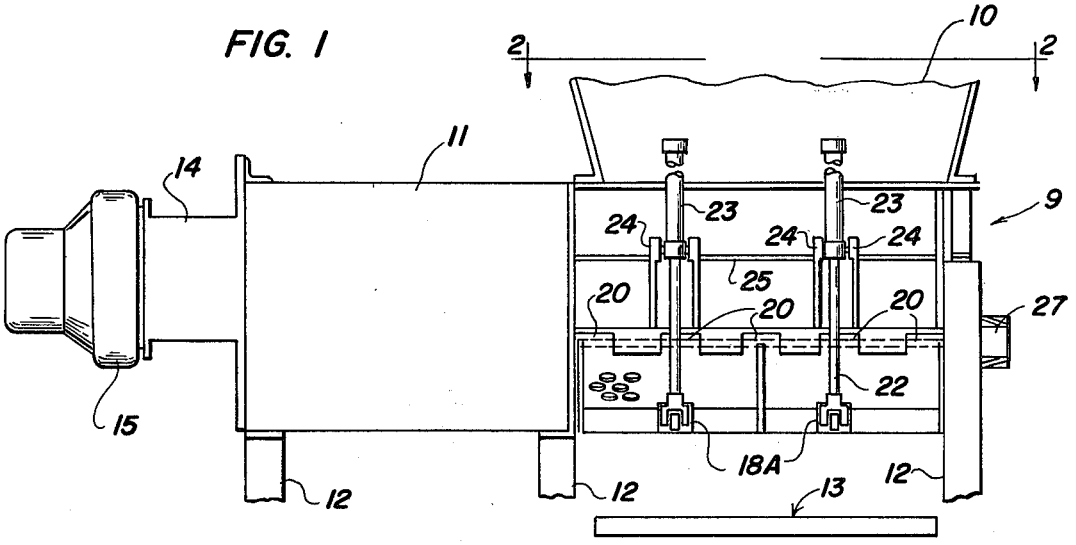
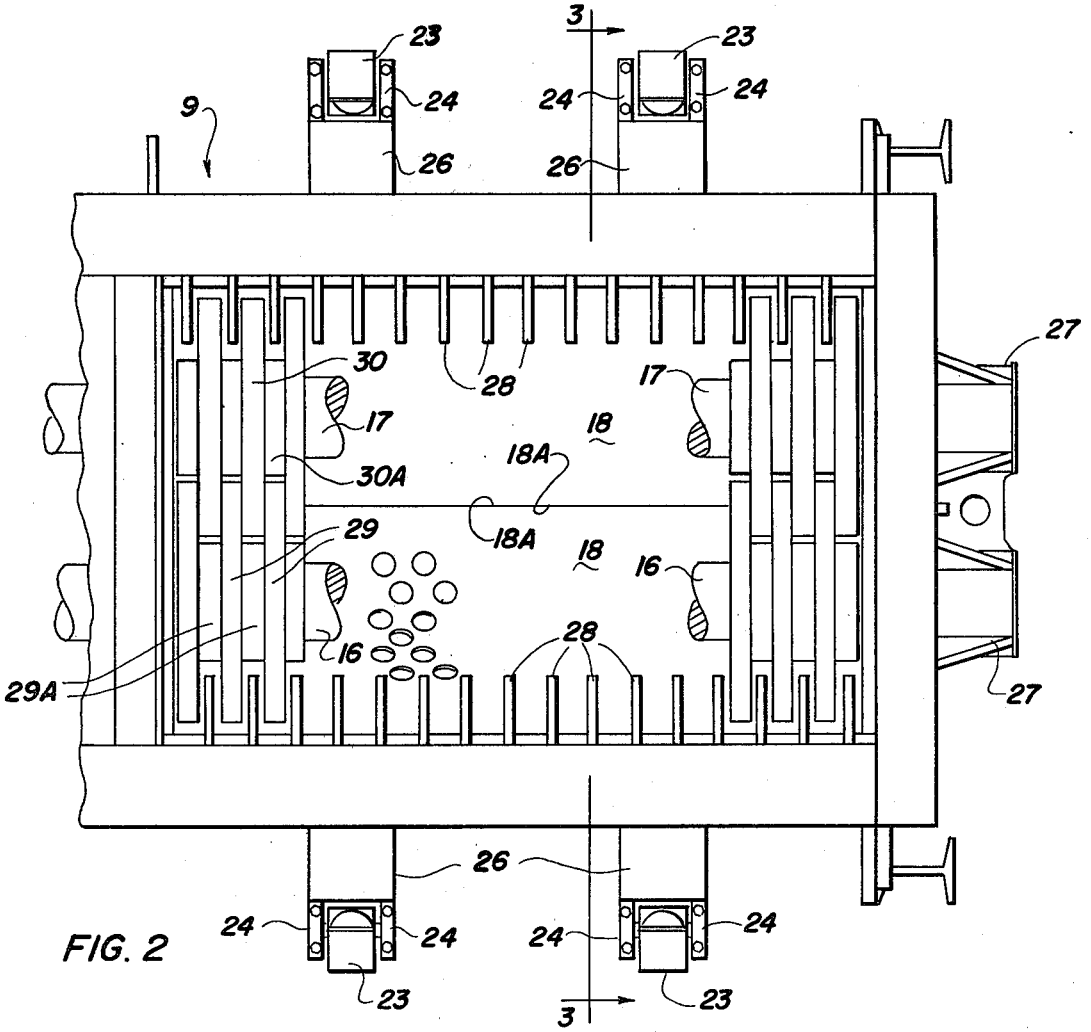
FIG. 2

WASTE MATERIAL BREAKING AND SHREDDING APPARATUS

BACKGROUND OF THE INVENTION

1. Field of the Invention

This invention relates to apparatus that is operative for breaking and shredding waste material so as to reduce it to a form suitable for disposal in ancillary processes, or for recycling.

2. Description of the Prior Art

Shredding apparatus for various items of waste material have been available in which parallel shafts have been provided with interleaved cutting or shearing elements. The shafts have been driven in opposite directions such that the interleaved elements operate to reduce the waste material in a shearing action, much like the action of scissors. It has been proposed also to provide the shredding apparatus with screen means at the outlet side of the shafts and interleaved elements to gauge the size of the reduced material. Furthermore, it has been proposed in prior apparatus to rotate the shafts at slow speeds and either in synchronism or at different speeds.

The prior shredding apparatus has embodied fluid pressure motor means arranged in closed loop or open loop drive hook-ups. Provision has been made to detect unusual rise in fluid pressure which takes place when waste material overloads or tends to stop shaft rotation. Such detection means has been arranged to reverse the normal direction of drive of the shafts for the purpose of relieving the overloads. Reversal of rotation has been instituted after a short time from initial detection of pressure rise, and restoration of the normal drive direction has been controlled by suitable timing devices.

Shredding apparatus of the type in which parallel, counter-rotating shafts, with shredding elements are employed, is exemplified by U.S. Pat. Nos. Panning et al 3,502,276 of Mar. 24, 1970; Brewer 3,578,252 of May 11, 1971; Rossler 3,662,964 of May 16, 1972; Schweigert et al 3,664,592 of May 23, 1952; Goldhammer 3,860,180 of Jan. 14, 1975; Cunningham et al 3,868,062 of Feb. 25, 1975; Baikoff 3,991,944 of Nov. 16, 1976; and Culbertson et al 4,034,918 of July 12, 1977. The patents of Rossler and of Schweigert et al disclose fixed grates at the discharge side of comminuting apparatus.

There are problems common to the foregoing apparatus and those include systems in which there is only one way to drive the shafts for producing the desired effect of shredding waste material, and there is no provision made for turning out fine or coarse material. The prior art which is arranged to incorporate reverse rotation does so only to attempt to clear a jam condition.

SUMMARY OF THE INVENTION

The present invention is directed to improving the capability of shredders of the general class exhibited by the prior art examples to reduce waste material in such a way as to produce fine or coarse products, as well as to reduce material by breaking it into short lengths.

General objects of the present apparatus are to provide operating components for breaking up elongated waste and for shredding the waste after being broken, and to provide cage means at the output side of the rotary shafts which may be held in selected positions for the purpose of sizing the waste material passed through the apparatus.

More specific objects of the present apparatus are to provide drive means for the parallel shafts capable of rotating the shafts with cutter elements thereon in either direction such that the cutter elements rotate and pass each other while moving in clockwise and counter-clockwise directions, and to provide cage means at the outlet for grading the size of the reduced waste material.

A further object is to provide cage means with comb teeth which cooperate with the cutter elements on the rotating shafts for breaking up elongated waste material, and pressure responsive means for yieldably controlling the position of the cages and comb teeth in relation to the cutter elements on the rotating shafts.

Another object is to provide cage means for a waste material reducing apparatus and to have comb teeth carried by the cage means in position to perform dual functions of cleaning the rotary cutting elements of material that may tend to tangle up in such elements, as well as act with the rotary cutting elements to break up elongated and/or coarse waste material.

An additional object is to provide an hydraulic pressure system for driving the rotary shafts in the present apparatus, and for regulating pressure responsive cylinders connected to cage members for positioning the cage members in any one of several positions to obtain the desired product size.

Still another object of the present invention is to provide the present apparatus with auto-jamming means so that material responsible for causing a jam can be discharged and separated from the desirable output from the apparatus.

A preferred embodiment of the present invention comprises a frame for supporting parallel shafts within a waste material receiving hopper, hydraulic drive and control means for the apparatus, cage means adjacent the bottom outlet of the hopper, and movably positioned by hydraulic motor means, comb teeth carried adjacent the cage means for movement with the cage means, and cutter elements on the shafts arranged in cooperating relation for passing each other between the shafts and for passing between comb teeth at the outside of the shafts. Such apparatus has several modes of operation, depending on whether the cage means is open and the shafts turn away from each other to move the cutting elements outwardly away from each other, or whether the cage means is partly or wholly closed and the shafts turn toward each other to move the cutter elements inwardly toward each other.

BRIEF DESCRIPTION OF THE DRAWINGS

A preferred embodiment of the present apparatus is illustrated in the accompanying drawings, wherein:

FIG. 1 is a side elevational view of the apparatus embodying the features of the present invention;

FIG. 2 is an enlarged and fragmentary view as seen from the top with portions broken away to reveal detail, the view being taken along line 2—2 in FIG. 1;

DETAILED DESCRIPTION OF THE PREFERRED EMBODIMENT

Figure 3:
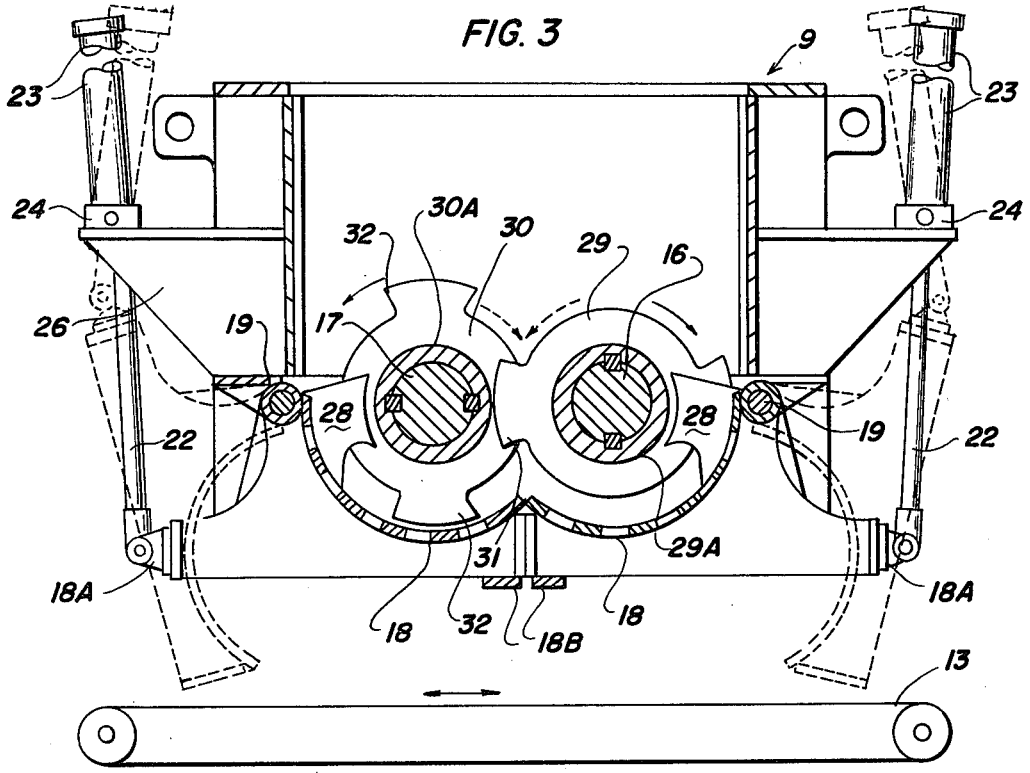
FIG. 3 is a transverse section taken along line 3—3 in FIG. 2 to show a typical arrangement of cutter discs, cage means, comb teeth and cage actuators.

Referring now to the drawings, there is disclosed in FIG. 1 a general view of the apparatus in which there is a frame 9 enclosing the material shredding components, and a material receiving hopper 10. A gear box 11 is attached to the frame 9 and the two components are supported on suitable legs 12 so as to raise the frame 9 sufficiently to accommodate a conveyor 13 which will be referred to in more detail. The gear box 11 is provided with a coupling device 14 associated with a hydraulic motor 15 of a type that may be reversed, as will be described presently. It is not believed necessary to provide details of the gear mechanism in the gear box 11 as that is considered to be constituted of well known components through which a single shaft (not shown) projecting from the coupling 14 drives suitable gears for rotating shafts 16 and 17 (see FIG. 2) in opposite directions and at differential rates of rotation.

It can be seen in FIG. 1 that the bottom of the frame 9 carries a cage 18 which is supported on a hinge shaft 19 which is directed through elements 20 formed as part of the cage 18. The parts 20 make up a piano hinge assembly with stationary parts 21 carried on the frame in any convenient manner. The cage 18 seen in FIG. 1 is operated by actuator means in the form of a pair of piston rods 22 projecting from cylinders 23. The cylinders 23 are pivotally mounted in bearing supports 24 carried by a longitudinal structural member 25 on the frame 9. The apparatus has a second cage 18 which is a duplicate of the one described above.

Turning now to FIGS. 2 and 3, the frame is provided with structural brackets 26 which form outrigger supports for the bearings 24. In the view of FIG. 2, there are a pair of actuator cylinders 23 at each longitudinal side of the frame 9, and each pair of cylinders 23 is operatively connected by piston rods 22 with a cage 18 at pivot bracket 18A. There are two cages which when closed come together at meeting faces located substantially in the longitudinal center line between the shafts 16 and 17. Stop elements 18B are provided to locate the cages. The shafts 16 and 17 are suitably supported in outboard bearing assemblies 27 at the end opposite the location of the gear box 11.

Each cage 18 carries a plurality of spaced comb teeth 28 arranged in spaced relation such that the shredding discs 29 on shaft 16 interleave with shredding discs 30 on shaft 17 and the respective shredding discs on shaft 16 are held in spaced relation by spacers 29A and the shredding discs on shaft 17 are held in spaced relation by spacers 30A. Furthermore, the comb teeth 28 have a thickness such that there is a gap or space between each thereof and a pair of adjacent shredding discs, and the comb teeth project radially toward the shafts 16 and 17, when the cages 18 are in the closed position shown in FIG. 3, so as to approach the spacers 29A and 30A for the purpose of preventing stringy type waste material from becoming entangled with the shredding discs 29 and 30. Each of the shredding discs 29 and 30 are formed with a pair of radially projecting cutting teeth 31 and 32 which have symmetrical and oppositely directed cutting edges which during rotation of the shafts 16 and 17, pass close to the discs 29 and 30 so as to create a scissor type shearing action.

The normal direction of operation of the shafts 16 and 17, as viewed in FIG. 3, is with the cutting teeth 31 and 32 rotated in a direction inwardly so that they pass downwardly between the shafts. When the cages 18 are closed, the teeth 31 and 32 continue to work on the waste material and reduce it to size such that it will eventually pass through the cage openings and fall onto the conveyor 13 to be transported to a suitable holding station. In the closed position of the cages 18, the comb teeth 28 are so positioned that elongated material may be captured by the cutting teeth 31 and 32 in such a position that the elongated material will be broken over the lower edge of the comb teeth 28. When the shafts 16 and 17 are reversed and rotate to cause the cutting teeth 31 and 32 to pass upwardly between the shafts, elongated waste material like tubing, packing crates, pallets and the like, will be caused to bridge one or more of the comb teeth 28 so as to be sharply struck by the teeth 31 and 32 for the purpose of breaking that material into smaller parts. Regardless of the direction of the rotation of the shafts 16 and 17, and with the cages in the fully closed position of FIG. 3, the comb teeth 28 are in a position to substantially prevent waste material from winding itself around the spacer discs 29A or 30A, as well as to perform the function of cooperating with the cutting teeth 31 and 32 for reducing the waste material so it will pass through the cages and fall onto conveyor 13. The working chamber for the shredding discs and cutting teeth in frame 9 may be completely opened at the bottom by operating the actuator cylinders 23 to move the cages into the dotted line position, thereby allowing waste material to pass through quite easily. When the cages are in the retracted or fully opened position, the comb teeth 28 are substantially withdrawn from the path of travel of the cutting teeth 31 and 32.

Figure 4:
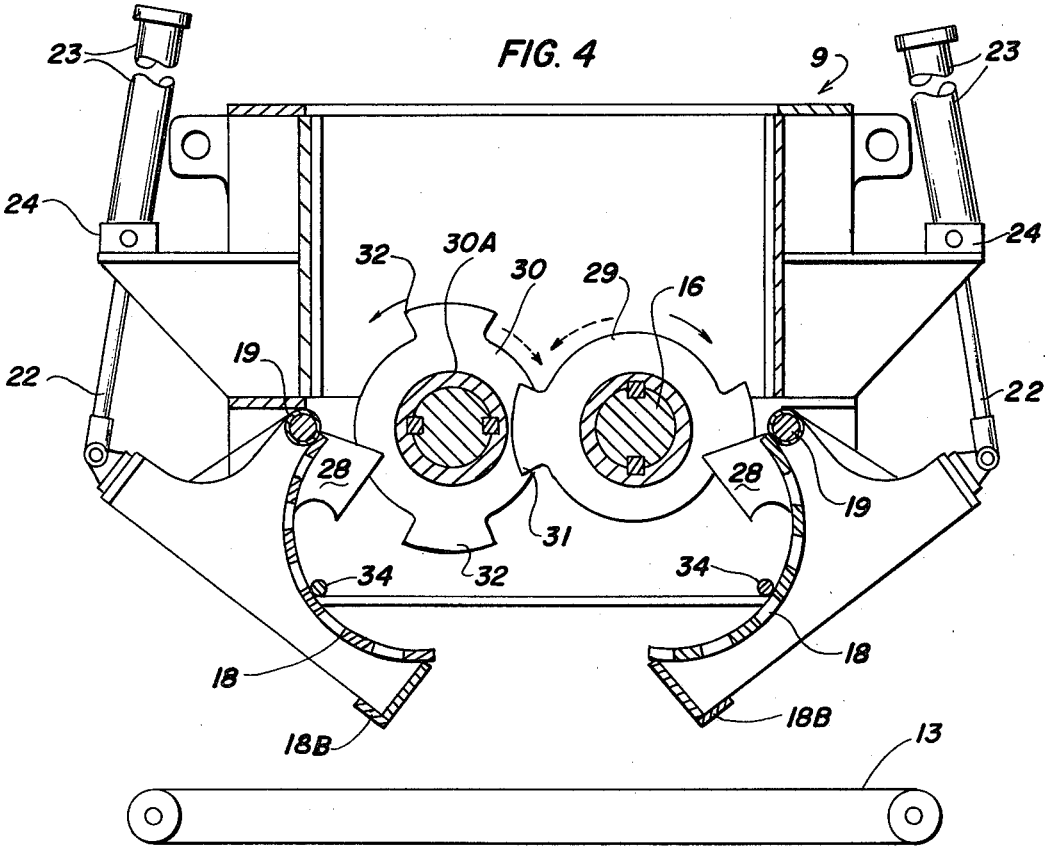
FIG. 4 is fragmentary view similar to FIG. 3 but showing an adjusted position of the cage means.

In the view of FIG. 4, the cages 18 are shown in a partly open position which is retained by manually inserting elongated rods 34 through the opposite end walls of the frame 9 before the cages are moved out of the fully retracted positions. The rods 34 are abutted by the surfaces of the cages 18, and thereby position the comb teeth 28 in operative positions with respect to the shafts 16 and 17 and the shredding discs 29 and 30 carried thereby. The mounting of the cages 18, first described in connection with FIG. 1, pivot about the hinge shafts 19 so that the comb teeth 28 are positioned so as to effectively cooperate with the shredding discs 29 and 30 and the respective teeth thereon, eccept in the position when the actuators 23 completely withdraw the cages 18. An important feature of this invention resides in the selective positioning of the cages 18 and the comb teeth 28 thereon so as to permit the apparatus to produce a fine product as measured by the size of the openings in the cages, as well as a coarse product when the cages 18 are retained in partly opened position by the use of the bars 34. The apparatus is capable of breaking up and shredding elongated objects over the stationary comb teeth 28 by rotating the shafts such that the cutting teeth 31 and 32 pass downwardly around the outside of the shafts 16 and 17.

Figure 5:
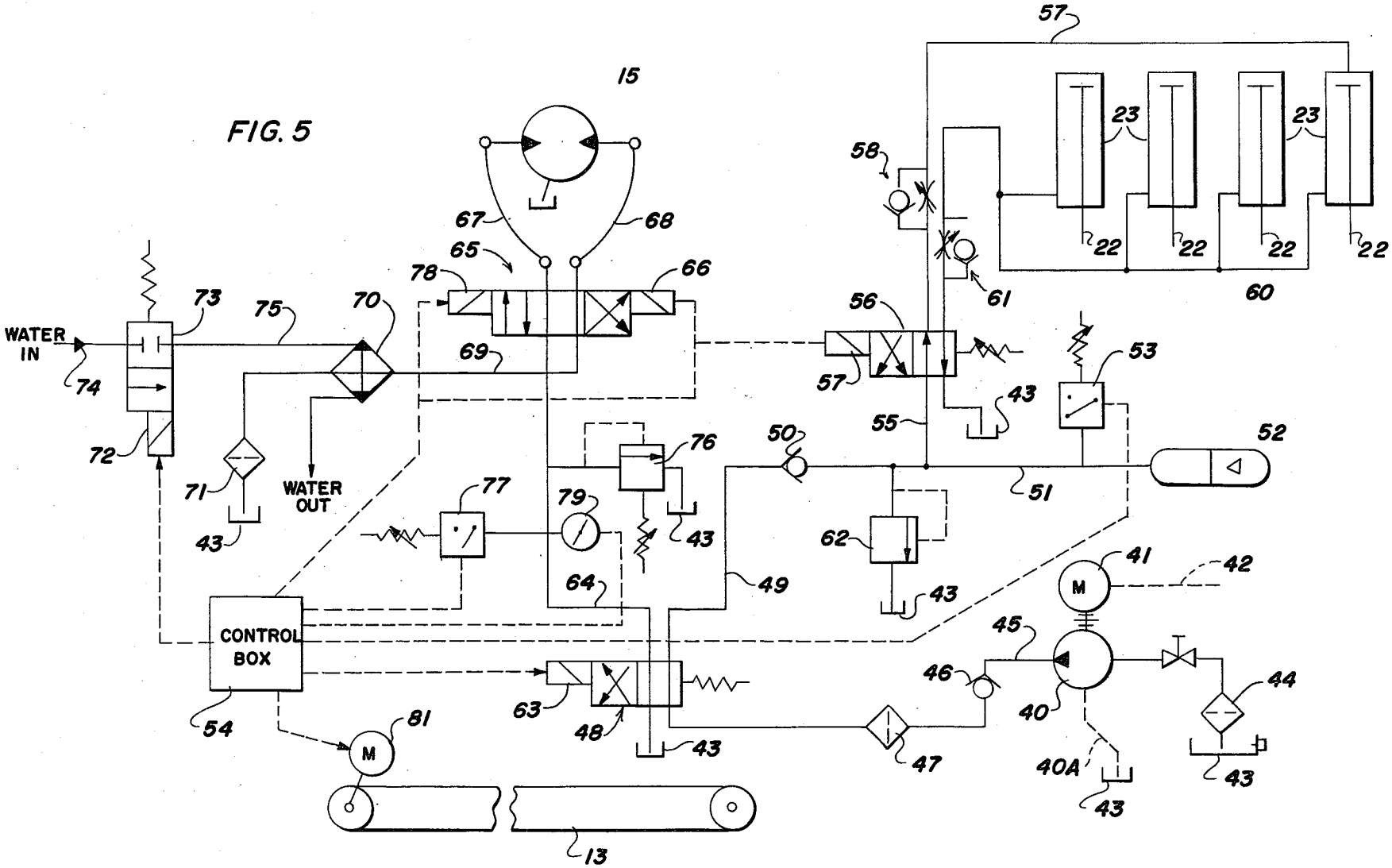
FIG. 5 is a hydraulic circuit diagram of a control system applicable to the foregoing apparatus.

FIG. 5 is a schematic disclosure of the hydraulic drive system and the controls associated therewith. As noted above, the parallel shafts 16 and 17 are driven through the gear box 11 and the coupling 14 by a reversible hydraulic motor 15. The cage means 18 controlling the bottom outlet of the frame 9 are positioned by hydraulic piston-cylinder actuators 23. The preferred hydraulic system is made up of a unidirectional pump 40 driven by electric motor 41 having the electrical supply 42 of a suitable capacity. The pump 40 draws hydraulic fluid from reservoir 43 through a filter 44, and leakage through the pump is collected and returned by line 40A to the reservoir 43. The pump output is conducted by conduit 45 past a check valve 46 and filter 47 to a flow directing valve 48 which has a normal spring controlled position in which the pressure fluid is directed into conduit 49 and past a check valve 50 into conduit 51 connected to an accumulator 52 which is charged with fluid to a suitable pressure level. When the desired pressure is reached, an adjustable pressure sensor 53 responds and transmits a signal into the controls (not believed necessary to show in detail) assembled in box 54.

Concurrently with the charging of the accumulator 52, pressure fluid is directed by conduit 55 through valve 56 which has a normal spring controlled position in which the pressure fluid passes in conduit 57 and a flow control modulator 58 to each of the actuators 23 to displace the piston rods 22 in a direction to close the cages 18 in the bottom of the frame 9. The opposite ends of the actuators 23 are connected by a common conduit 60 to return pressure fluid through the flow control modulator 61 to the return side of valve 56 and reservoir 43. The modulators prevent the actuators slamming the cages 18 open or shut by metering the fluid flow at a desired rate. A safety overload device 62 is connected into conduit 51 to protect the system on the accumulator side of the check valve 50.

When the pressure sensor 53 sends its signal into the control box 54, a control signal is transmitted to the solenoid 63 at valve 48 to shift it into a position where the pressure fluid in conduit 45 is directed into conduit 64 to flow to the reversing control valve 65. Valve 65 is shifted out of its normal neutral flow position by solenoid 66 which is responsive through control box 54 to the signal from pressure sensor 53. Thus, pressure fluid in conduit 64 is supplied to the reversible motor 15 through hose 67 to drive it in a forward direction in which the shafts 16 and 17 rotate toward each other, as viewed from the top. The return flow from motor 15 through hose 68 is directed by valve 65 into conduit 69 and through a water cooled heat exchanger 70 to the reservoir 43 through filter 71. The signal from sensor 53 to initiate operation of the motor 15 also energizes solenoid 72 at the water supply control valve 73 to admit cooling water from source 74 into conduit 75 connected to the heat exchanger 70. Cooling water is continued to be supplied to the heat exchanger 70 as long as pressure fluid is supplied to the motor. Also, the pressure fluid supply conduit 64 to motor 15 is provided with a pressure relief device 76.

There are occasions when material fed to the shredder apparatus will cause a jam of sufficient magnitude to stop the rotation of the shafts 16 and 17. When that happens, a pressure sensor 77 responds to pressure increase in conduit 64 at a value less than that which will open the relief device 76. The signal from sensor 77 is transmitted into the control box 54 which then emits a signal to a solenoid 78 at valve 65 for reversing the rotation of motor 15 for a very short period of time, as determined by a timer (not shown) in control box 54. The timer will time out and signal the solenoid 66 to return valve 65 for forward rotation of motor 15. If the cause of the slow down is not overcome on the first reversal, the solenoid 78 is reenergized to again reverse motor 15 for a like short time period. The timer (not shown) is responsive to each time the sensor 77 responds to a pressure rise, and a counter device 79 sends signals into the control box such that if the reversing cycles of motor 15 continue more than three times within thirty seconds, or some other desired elapsed time, the controls will emit a signal to solenoid 57 to operate valve 56 to cause it to connect the accumulator to conduit 60 for causing the actuators 23 to open the cages 18 and allow the material causing the jam to be dumped. This last event takes place while the motor 15 is in its reversing cycle.

As shown in FIGS. 3 and 4, the apparatus includes the conveyor 13 driven by motor 81 in a normal direction to move the shredder output to a suitable collecting station (not shown). When the shredder encounters material which causes a jam-up, and reversing the motor 15 does not clear the jam, the control causes the motor 15 to continue reverse running and cages to open and reverses the conveyor motor 81 so that the material to be dumped will be conducted by the conveyor 13 to a second collecting station for discard.

In the preferred embodiment described above, the hydraulic circuit diagram depicts the use of a single pump 40 supplying hydraulic pressure fluid to the circuit for the actuators 23, as well as the circuit for the reversible motor 15. An equivalent arrangement is available where there are separate pumps, one pump being connected to conduit 49 thus eliminating the valve 48, and the second pump being connected to conduit 64 leading to the control valve 65. It is not believed necessary to show this dual pump arrangement, as those persons versed in this art are aware of using separate pumps where two systems have different functions to perform.

What is claimed is:

1. Apparatus for reducing waste material comprising: a frame defining a working chamber having a waste material receiving opening and a waste material discharge; a pair of substantially parallel shafts operably supported in said frame above said discharge; drive means connected to said pair of shafts for rotating said shafts in forward and reverse directions; cutter teeth carried by each shaft in spaced apart positions such that cutter teeth on one shaft interfit in the spaces between cutter teeth on the other shaft for either direction of shaft rotation, said cutter teeth on each shaft being formed with radially projecting teeth effective for reducing waste material in either direction of shaft rotation; cage means operably carried by said frame for movement into selected fixed position, one of which positions is to extend across said working chamber discharge, said cage means carrying a series of comb elements fixed thereon and presented inwardly toward said cutter teeth such that for shaft rotation to move said radially projecting teeth past said fixed comb elements, said comb elements and projecting teeth cooperate to break elongated waste material over said comb elements in either direction of rotation, and being divided into two parts for meeting at a position below said pair of shafts; and actuator means connected to said cage means for moving said cage means between positions withdrawn from said working chamber discharge for releasing non-reducible material and positions selectively extending across said working chamber discharge for sizing the waste material.

2. The apparatus of claim 1, wherein with said cage means extending across said discharge and said cutter teeth moving downwardly between said shafts waste material is shredded beneath said shafts and said comb elements are in position for clearing waste material from between said cutter teeth.

3. The apparatus of claim 1, wherein said cage means carry comb elements in fixed positions to align with the spaces between cutting teeth on said shafts, and fluid pressure control means is connected to said actuator means connected to said cage means for selectively positioning said cage means relative to said bottom discharge for releasing waste material varying in size of reduction depending on the position selected for said cage means, said fixed comb teeth presenting surfaces for cooperating with said cutting teeth in the reduction of waste material.

4. Apparatus for reducing waste material and for varying the size thereof comprising:

(a) a pair of counter-rotating substantially parallel shafts, each shaft carrying spaced apart discs formed with cutting teeth, which spaced discs interfit during shaft rotation and cooperate with each other in reduction of waste material;

(b) a frame supporting said shafts and providing inlet means for waste material and an outlet for the movement of reduced waste material;

(c) cage means movable mounted on said frame adjacent said outlet to assume a position normally retaining unreduced waste material against movement through said outlet;

(d) comb teeth carried by said cage means in position to project into the spaces between said spaced discs for cleaning waste material from between said discs and for cooperation with said cutting teeth in the reduction of waste material;

(e) actuator means connected to said cage means for moving said cage means into positions different from said normal position relative to said outlet to control the size of reduction of the waste material;

(f) hydraulic motor means for driving said counter-rotating shafts in opposite directions; and (g) hydraulic fluid circuit means containing said motor means and said actuator means.

5. The apparatus set forth in claim 4, wherein said cutting teeth formed on said spaced discs are radially directed and present opposed waste material reducing edges for reducing waste material in either direction of rotation of said pair of shafts.

6. The apparatus set forth in claim 4, wherein said comb teeth are formed with opposed edges presented in the path of movement of said cutting teeth for either direction of rotation of said pair of shafts.

7. The apparatus set forth in claim 4, wherein said actuator means are movable into positions for removing said cage means and comb teeth from preventing waste material passage through said outlet.

8. The apparatus set forth in claim 4, wherein said hydraulic fluid circuit means includes a fluid pump selectively connectable to said actuator means for moving said cage means relative to said outlet, and connectable to said motor means for rotating said pair of shafts, and fluid pressure responsive means contained in said circuit means for sensing a rise in pressure to said motor means and periodically reversing said motor means for a predetermined time after which said motor means stays in reverse rotation and said actuator means move said cage means to open said outlet to permit discharge of waste material responsible for the rise in pressure.

* * * * *